US007262740B2

(12) United States Patent
Tikhov et al.

(10) Patent No.: US 7,262,740 B2
(45) Date of Patent: Aug. 28, 2007

(54) SMALL PLANAR ANTENNA WITH ENHANCED BANDWIDTH AND SMALL RECTENNA FOR RFID AND WIRELESS SENSOR TRANSPONDER

(75) Inventors: Yuri Tikhov, Suwon-si (KR); Young-hoon Min, Anyang-si (KR); Yong-jin Kim, Seoul (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 75 days.

(21) Appl. No.: 11/207,724

(22) Filed: Aug. 22, 2005

(65) Prior Publication Data

US 2006/0038724 A1 Feb. 23, 2006

(30) Foreign Application Priority Data

Aug. 21, 2004 (KR) ..... 10-2004-0066159
Mar. 30, 2005 (KR) ..... 10-2005-0026496

(51) Int. Cl.
*H01Q 13/10* (2006.01)

(52) U.S. Cl. ..... 343/770; 343/768

(58) Field of Classification Search ..... 343/767, 343/770, 768

See application file for complete search history.

(56) References Cited

U.S. PATENT DOCUMENTS

| | | | | |
|---|---|---|---|---|
| 4,922,263 | A | 5/1990 | Dubost et al. | |
| 5,268,696 | A * | 12/1993 | Buck et al. | 342/372 |
| 6,573,872 | B2 * | 6/2003 | Oberschmidt et al. | 343/767 |
| 2005/0285809 | A1 * | 12/2005 | Louzir et al. | 343/770 |

FOREIGN PATENT DOCUMENTS

| | | | |
|---|---|---|---|
| WO | WO 03/044892 | A1 | 3/2003 |
| WO | WO 03/094293 | A1 | 11/2003 |
| WO | WO 2004/047222 | A1 | 6/2004 |

OTHER PUBLICATIONS

Azadegan R et al., "Design of miniaturized slot antennas", IEEE Antennas and Propagation Society International Symposium. 2001 Digest. APS. Boston, MA, Jul. 8-13, 2001, New York, NY: IEEE, US, vol. 1 of 4, Jul. 8, 2001, pp. 565-568, XP010564702.

Mclean J S: "A Re-Examination of the Fundamental Limits on the Radiation Q of Electrically Small Antennas", IEEE Transactions on Antennas and Propagation, IEEE Inc. New York, US, vol. 44, No. 5, May 1, 1996, pp. 672-675, XP000584236.

L. J. Chu, "Physical Limitations of Omni-Directional Antennas", Massachusetts Institute of Technology, Research Library of Electronics, Boston, Massachusetts, received May 27, 1948, vol. 19, Dec. 1948, pp. 1163-1165.

Harold A. Wheeler et al., "Fundamental Limitations of Small Antennas", Proceedings of the I.R.E., decimal classification: R120, original manuscript received by the Institute, Nov. 11, 1946, presented at the I.R.E. national Convention, Mar. 6, 1947, pp. 1479-1484.

* cited by examiner

*Primary Examiner*—Hoanganh Le
(74) *Attorney, Agent, or Firm*—Sughrue Mion, PLLC

(57) ABSTRACT

A small planar antenna with an enhanced bandwidth and a small rectenna for RFID (Radio Frequency Identification) and wireless sensor transponder are provided. The small planar antenna includes a dielectric substrate, a metal layer formed on an upper part of the dielectric substrate, a main slot formed in pattern on the metal layer, and a plurality of sub-slots connected to the main slot and winding in a specified direction, and the plurality of sub-slots form a pair of symmetric sub-slot groups around the main slot. According to the small planar antenna, the antenna region that substantially takes part in the radiation is substantially increased, and thus an enhanced bandwidth can be obtained without affecting the radiation pattern, radiation efficiency, polarization purity, etc., of the antenna.

9 Claims, 14 Drawing Sheets

SMALL PLANAR ANTENNA WITH ENHANCED BANDWIDTH AND SMALL RECTENNA FOR RFID AND WIRELESS SENSOR TRANSPONDER

This application claims benefit under 35 U.S.C. § 119 from Korean Patent Application No. 2005-26496, filed on Mar. 30, 2005, and from Korean Patent Application No. 2004-66159, filed on Aug. 21, 2004, in the Korean Intellectual Property Office, the disclosures of which are incorporated herein by reference.

BACKGROUND OF THE INVENTION

1. Field of the Invention

The present invention relates to a RF antenna and a microwave antenna, and more particularly to an electrically small planar antenna matched with an electronic chip of RFID (Radio Frequency Identification) and /or a wireless sensor transponder.

2. Description of the Related Art

At UHF-frequencies and in the L-band the size of even a single-half-wave dipole antenna is precluded in many mobile and Radio Frequency-Identification (RFID) applications. So small (relative to wavelength) antennas are in very high demand. However, the size of the antenna for a given application is not related mainly to the technology used, but is determined by well-known laws of physics. Namely, the antenna size with respect to the wavelength is the parameter that has the prevalent influence on the radiation characteristics.

All antennas are used to transform a guided wave into a radiated one, and vice-versa. Basically, to perform this transformation efficiently, the antenna size should be of the order of a half wavelength or larger. Of course, antenna can be smaller, but at expense of bandwidth, gain, and efficiency. So the art of antenna miniaturization is always an art of compromise among size, bandwidth, and efficiency.

As regards theoretical studies of antenna miniaturization, please refer to the following literature cited. [H. A. Wheeler, "Fundamental Limitations of Small Antennas," Proceedings of the IRE, vol. 35, pp. 1479-1484, December 1947; L. J. Chu, "Physical Limitation on Omni-Directional Antennas," Journal of Applied Physics, vol. 19, pp. 1163-1175, December 1948; and R. F. Harrington, "Effect of Antenna Size on Gain, Bandwidth and Efficiency," Journal of Research of the National Bureau of Standards—D. Radio Propagation, vol. 64D, pp. 1-12, January-February 1960].

According to these initial studies, the small antennas are constrained in their behavior by a fundamental limit: the smaller the maximum dimension of the antenna, the higher its Quality Factor (Q), or equivalently, the narrower its bandwidth. The computation of the smallest possible Q for a linearly polarized antenna was refined by McLean [J. S. McLean, "A Re-examination of the Fundamental Antenna Limits on the Radiation Q of Electrically Small Antennas," IEEE Transactions on Antennas and Propagation, vol. 44, pp. 672-676, May 1996].

Accordingly, the art of antenna miniaturization always requires a compromise among the size, bandwidth and efficiency (i.e., gain) of the antenna. In the case of a planar antenna, if most of the antenna region takes part in radiation, the most superior compromising point can be found. That is, the antenna miniaturization technology requires the compromise among the size, bandwidth and efficiency of the antenna.

An original way to make an antenna smaller than resonant size and yet keeping resonant features such as relatively high gain and efficiency is disclosed in WIPO Publication WO 03/094293. FIG. 1 illustrates the antenna disclosed in WO 03/094293.

Referring to FIG. 1, the antenna 1 includes a dielectric substrate 2, a feeder 5, a metal layer 3, a main slot 4 and a plurality of sub-slots 6*a* to 6*d* formed in pattern on the metal layer 3. The metal layer 3 that includes the main slot 4 and the sub-slots 6*a* to 6*d* forms a radiation part of the antenna 1.

Additionally, FIG. 2A is a view illustrating a radiation part of a conventional antenna having straight-line terminating slots, FIG. 2B is a view illustrating a radiation part of a conventional antenna having turn terminating slots, and FIG. 2C is a view illustrating a radiation part of a conventional antenna having a spiral terminating slots.

In FIGS. 2A to 2C, the same drawing reference numerals are used for a main slot and a metal layer that are the common constituent elements. A plurality of sub-slots 8*a* to 8*d*, 9*a* to 9*d*, and 10*a* to 10*d* having diverse shapes may be formed on each end part of the main slot 4.

The conventional antennas as described above, however, have the drawback in that their bandwidths are generally narrow. In diverse application fields, the small operating frequency bandwidth of a small antenna causes serious problems. Accordingly, it is preferable to provide a small antenna that can operate over an enhanced bandwidth without affecting the radiation pattern, gain and polarization purity of the antenna.

Meanwhile, an RFID (Radio Frequency Identification) transponder is a responsive tag appliance that transmits the contents of a built-in memory through a backscatter communication with an interrogator or a reader. A passive RFID transponder is not provided with a battery, but obtains all necessary energy from a carrier signal of a reader instead. A passive wireless sensor appliance includes a semiconductor chip (for example, ASIC (Application Specific Integrated Circuit)) connected to an antenna. Practically, a low-priced planar antenna and/or wireless sensor transponder for the RFID having a small electrical size has become a matter of great concern. Recently, even an antenna having a size of ¼ of a wavelength is excluded from many application fields.

However, the implementation of the small antenna in the RFID and/or wireless sensor transponder design causes another problem in that the semiconductor chip of the transponder essentially has a complex input impedance having a capacitive reactance. Accordingly, in order to operate the antenna in the bandwidth of an RFID system, the problem of the complex conjugate matching between the transponder antenna and the semiconductor chip should be solved.

The impedance matching between the semiconductor chip of the transponder and the antenna is important to the whole performance of the RFID system. That is, the mismatching exerts an important effect upon the maximum operation distance between the interrogator and the transponder. Due to specified safety regulations and other legislations, the power radiated from the interrogator is somewhat limited. But, a passive RFID transponder obtains the driving power by rectifying an interrogation signal delivered to the chip by the antenna.

A rectifying circuit is a part of the semiconductor chip such as ASIC, is provided with a number of diodes (for example, Schottky diodes) and capacitors, and substantially give rise to a complex input impedance having a capacitive reactance. Typically, the impedance of the semiconductor chip has several to several tens of active ohms and several hundreds of reactive ohms. Accordingly, the ratio of the resistance to the reactance is very high.

In the above-described situations, the conventional matching technology is implemented by an additional external matching circuit based on an inductor. However, this conventional method has a new problem in that its manufacturing cost is ridiculously increased. Additionally, this separation type matching circuit greatly reduces the performance of the system. Accordingly, the impedance of the antenna should directly match the semiconductor chip of the transponder.

Generally, a circuit that includes an antenna and a rectifying circuit is called a rectenna.

FIGS. 3A to 3F are views illustrating the conventional transponder antennas. The typical transponder antennas have a planar structure formed with metal strip patterns.

FIG. 3A shows a conventional half-wavelength dipole antenna. The impedance of the half-wavelength dipole antenna is matched to the impedance of the rectifier by lowering the radiation resistance of the antenna by parallel metal strips and increasing the reactance by a small loop. As described above, the half-wavelength antenna is excluded from many application fields. Another example of a half-wavelength antenna is illustrated in FIG. 3B. The impedance of the antenna illustrated in FIG. 3B is matched by two separated coils.

FIG. 3C shows a folded half-wavelength dipole antenna having separated coils. The separated coils may be replaced by planar narrow meander strip patterns having an inductive property. The antennas illustrated in FIGS. 3B, 3C and 3D may suffer an additional loss caused by the separated coils or the narrow strip meanders.

FIGS. 3E and 3F illustrate small antennas in which a loop and a dipole structure are combined. [World Intellectual Property Organization Publication WO 03/044892 A1 (2003 May 30 Bulletin 2003/43) entitled "Modified Loop Antenna with Omnidirectional Radiation Pattern and Optimized Properties for Use in an RFID Device" by Varpula et al].

The important defect of the antennas illustrated in FIGS. 3E and 3F is a relatively small antenna RCS (Radar Cross Section). The RCS indicates the property about how much the antenna scatters the electromagnetic energy of an incident wave field. Since the modulated RCS is essentially used for the data transmission from the transponder to the reader, the RCS of the rectenna is very important to the backscatter communication.

Accordingly, it is preferable to provide a rectenna provided with an electrically small conjugate matched antenna that can operate with an enhanced RCS all over increased bandwidth without affecting the radiation pattern, efficiency, polarization purity, etc.

SUMMARY OF THE INVENTION

The present invention has been developed in order to solve the above drawbacks and other problems associated with the conventional arrangement. An aspect of the present invention is to provide a small planar antenna that has an enhanced operating frequency bandwidth without affecting the radiation pattern, radiation efficiency, polarization purity, etc., of the antenna.

Another aspect of the present invention is to provide a rectenna that is provided with a small antenna conjugately matched to a transponder semiconductor chip, has an enhanced RCS and operating frequency bandwidth, and operates without affecting the radiation pattern, radiation efficiency, polarization purity, etc., of the antenna.

In order to achieve the above-described aspects of the present invention, there is provided a small planar antenna having an enhanced operating frequency bandwidth, according to an exemplary embodiment of the present invention, which comprises a dielectric substrate, a metal layer formed on an upper part of the dielectric substrate, a main slot formed in pattern on the metal layer, and a plurality of sub-slots connected to the main slot and winding in a specified direction, wherein the plurality of sub-slots form a pair of symmetric sub-slot groups around the longitudinal axis of the main slot.

The specified direction may be either of clockwise and counterclockwise directions.

The plurality of sub-slots may form a pair of symmetric sub-slot groups around the longitudinal axis of the main slot wire in opposite directions to each other.

The length of a wiring arm of the sub-slots may be smaller than ¼ of a wavelength at an operating frequency of the antenna.

The plurality of sub-slots may include a right-side first sub-slot wiring clockwise from a right-side upper end part of the main slot, a right-side second sub-slot wiring in an opposite direction to the right-side first sub-slot from an inside of the right-side first sub-slot, a right-side fourth sub-slot wiring in an opposite direction to the right-side first sub-slot from a right-side lower end part of the main slot, and a right-side third sub-slot wiring in an opposite direction to the right-side fourth sub-slot from an inside of the right-side fourth sub-slot.

The plurality of sub-slots may further include left-side first sub-slot wiring counterclockwise from a left-side upper end part of the main slot, a left-side second sub-slot wiring in an opposite direction to the left-side upper end part of the main slot, a left-side second sub-slot wiring in an opposite direction to the left-side first sub-slot from an inside of the left-side first sub-slot, a left-side fourth sub-slot wiring in an opposite direction to the left-side first sub-slot from a left-side lower end part of the main slot, and a left-side third sub-slot wiring in an opposite direction to the left-side fourth sub-slot from an inside of the left-side fourth sub-slot.

The length of the main slot may be smaller than a half wavelength at an operating frequency of the antenna.

The width of the sub-slot may be the same as that of the main slot.

The width of the sub-slot may be narrower than that of the main slot.

The width of the sub-slot may be wider than that of the main slot.

The small planar antenna having the enhanced operating frequency bandwidth according to an exemplary embodiment of the present invention may further comprise a feeder having a microstrip line composed of an open-ended capacitive probe provided on a rear surface of the dielectric substrate.

The width of the probe may be the same as that of a strip width of the microstrip line.

The width of the probe may be narrower than that of a strip width of the microstrip line.

The width of the probe may be wider than that of a strip width of the microstrip line.

The small planar antenna according to an exemplary embodiment of the present invention may further comprises a feeder having a transmission line positioned on a rear or on an upper surface of the dielectric substrate.

In another aspect of the present invention, there is provided a small rectenna which comprises a dielectric substrate, a metal layer formed on an upper part of the dielectric substrate, a main slot formed in pattern on the metal layer, a plurality of sub-slots connected to the main slot and winding in a specified direction, a plurality of first transverse slots formed at right angles to the main slot on an upper part of the main slot, a plurality of second transverse slots formed at right angles to the main slot under a lower part of the main slot, and an inlet of a semiconductor chip formed inside the main slot.

The main slot, the plurality of sub slots and the plurality of first and second transverse slots may perform a conjugate impedance matching of the small rectenna without any external matching element, so that the small rectenna has an enhanced RCS (Radar Cross Section) in an operating bandwidth of a transponder.

The first and second transverse slots may be divided into two symmetric groups, respectively, by longitudinal axis of the main slot.

The specified direction may be either of clockwise and counterclockwise directions.

The plurality of sub-slots that form a pair of symmetric sub-slot groups around the longitudinal axis of the main slot may wind in opposite directions to each other.

The plurality of sub-slots may include a right-side first sub-slot wiring clockwise from a right-side upper end part of the main slot, a right-side second sub-slot wiring in an opposite direction to the right-side first sub-slot from an inside of the right-side first sub-slot, a right-side fourth sub-slot wiring in an opposite direction to the right-side first sub-slot from a right-side lower end part of the main slot, and a right-side third sub-slot wiring in an opposite direction to the right-side fourth sub-slot from an inside of the right-side fourth sub-slot.

The plurality of sub-slots may further include left-side first sub-slot wiring counterclockwise from a left-side upper end part of the main slot, a left-side second sub-slot wiring in an opposite direction to the left-side first sub-slot from an inside of the left-side first sub-slot, a left-side fourth sub-slot wiring in an opposite direction to the left-side first sub-slot from a left-side lower end part of the main slot, and a left-side third sub-slot wiring in an opposite direction to the left-side fourth sub-slot from an inside of the left-side fourth sub-slot.

The dielectric substrate and the metal layer may be planar.

The semiconductor chip may further include a rectifying circuit.

In another aspect of the invention there is an antenna with a dielectric substrate, a metal layer formed on an upper part of the dielectric substrate, a main slot formed on the metal layer and a plurality of sub-slots at each of a right and a left side of the main slot. The sub-slots at the right side of the main slot include a first group of sub-slots and a second group of sub-slots and the first group of sub-slots and the second group of sub-slots are symmetrical to one another about the longitudinal axis of the main slot.

It may be preferable that the sub-slots at the left side of the main slot comprise a third group of sub-slots and a fourth group of sub-slots and wherein the third group of sub-slots and the fourth group of sub-slots are symmetrical to one another about the longitudinal axis of the main slot.

It may be preferable that the first, second, third and fourth groups of sub-slots each comprise a pair of sub-slots that wind in opposite directions.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE EXEMPLARY EMBODIMENTS

Figure 1:
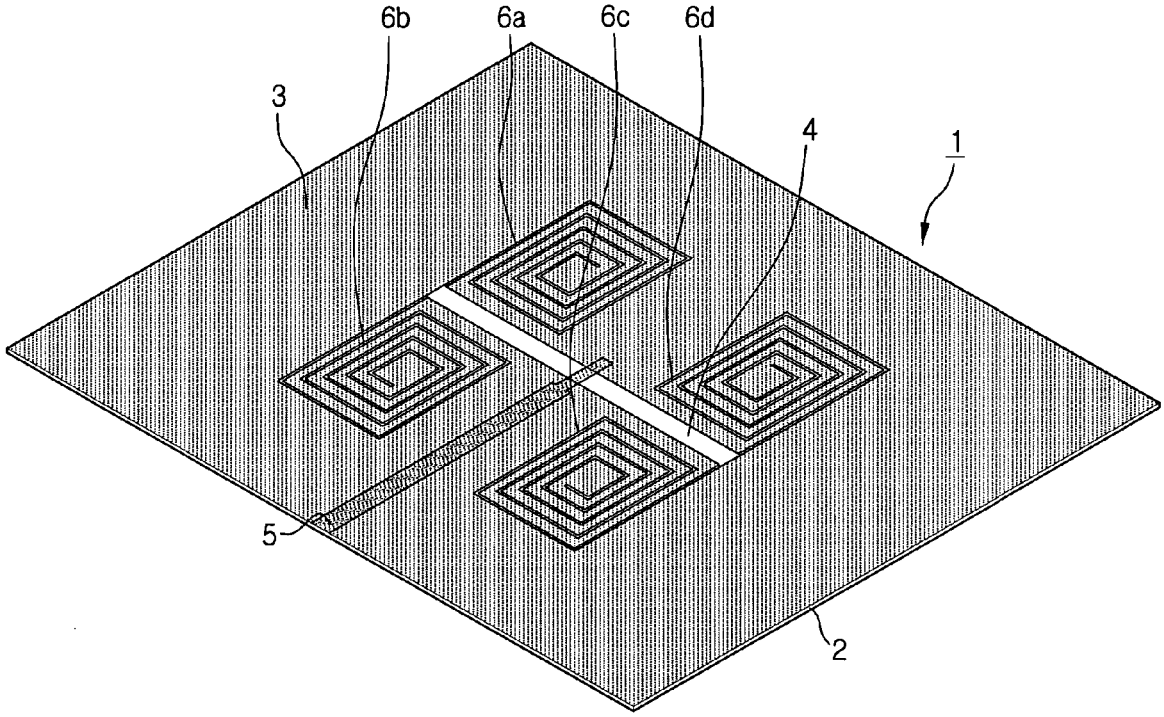
FIG. 1 (PRIOR ART)
FIG. 1 is a view illustrating a conventional antenna disclosed in WO 03/094293.
Figure 2A:
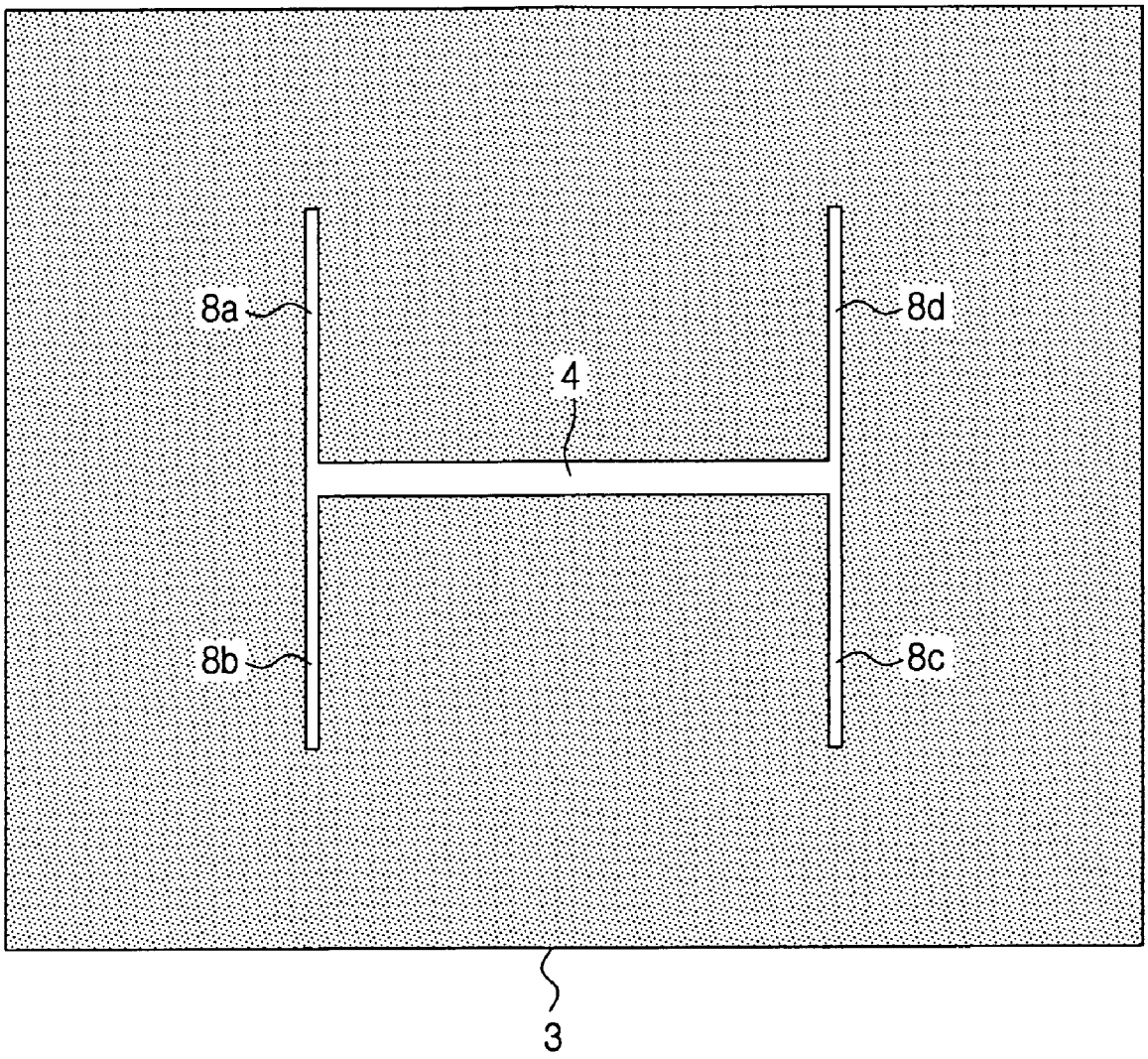
FIG. 2A (PRIOR ART)
FIG. 2A is a view illustrating a radiation part of a conventional antenna having straight-line terminating slots.
Figure 2B:
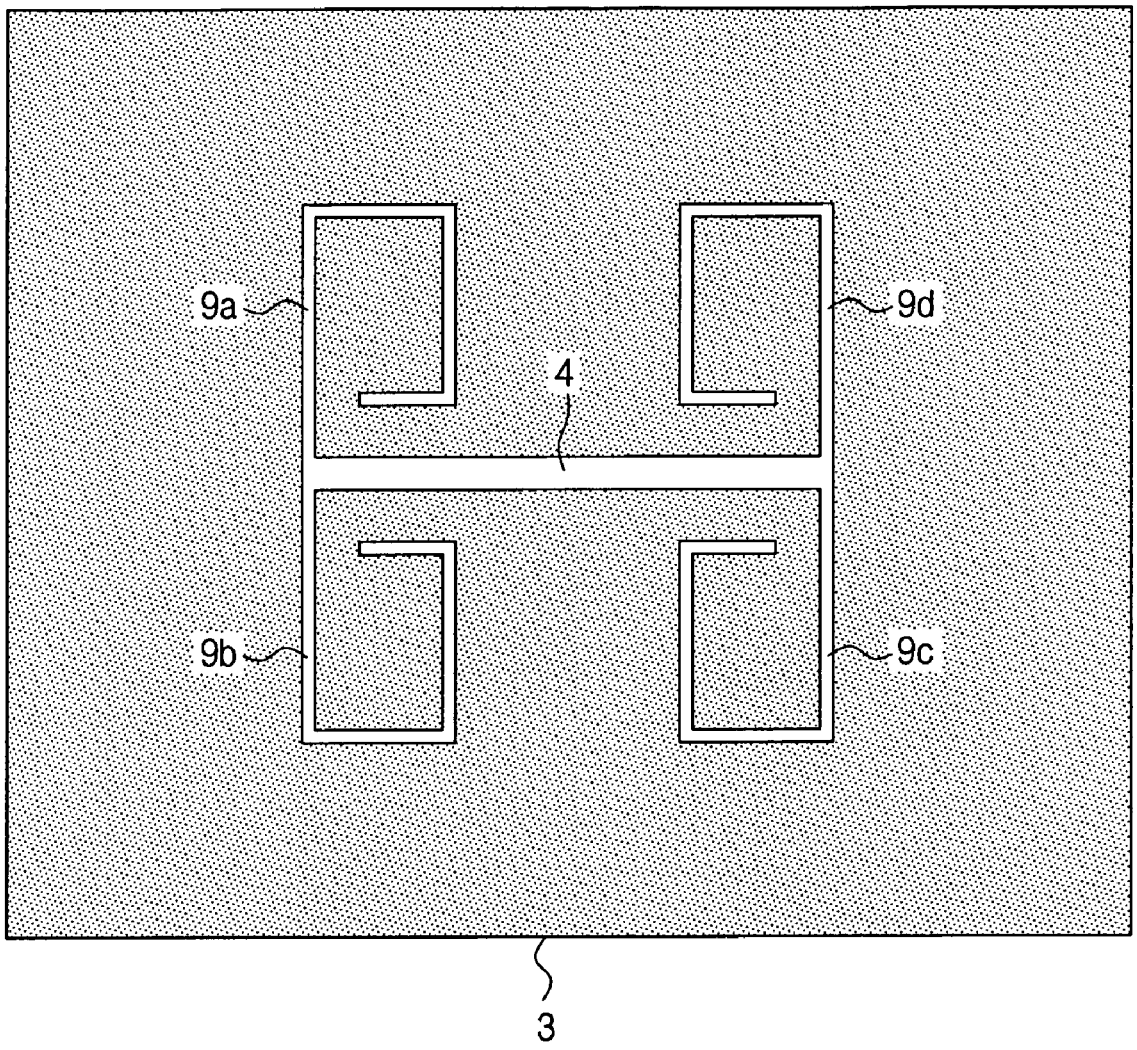
FIG. 2B (PRIOR ART)
FIG. 2B is a view illustrating a radiation part of a conventional antenna having turns of terminating slots.
Figure 2C:
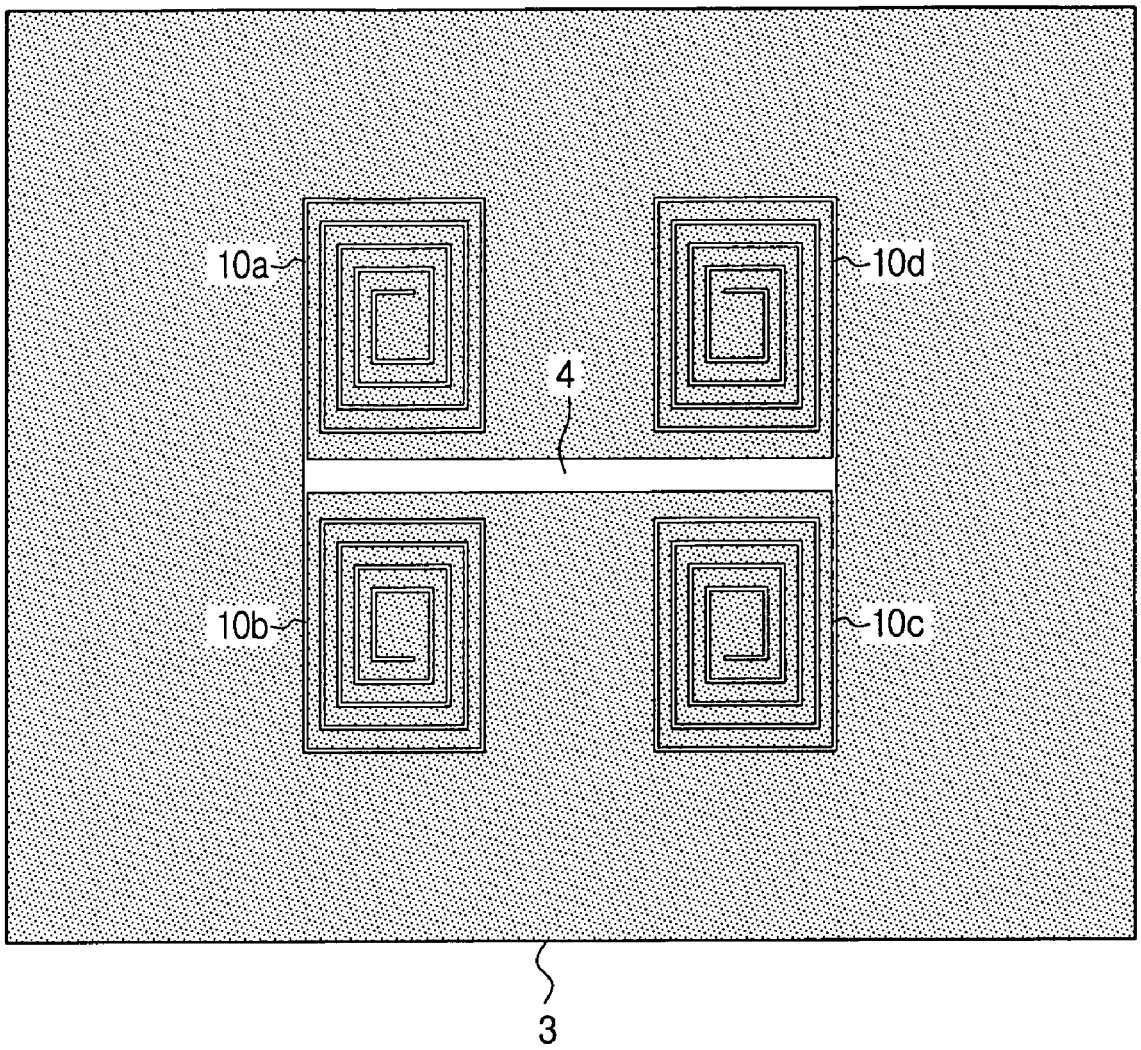
FIG. 2C (PRIOR ART)
FIG. 2C is a view illustrating a radiation part of a conventional antenna having a spiral terminating slots.
Figure 3A:
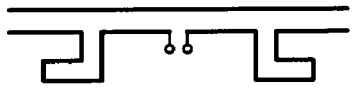
FIG. 3A (PRIOR ART)
FIGS. 3A to 3F are views illustrating conventional transponder antennas.
Figure 3B:
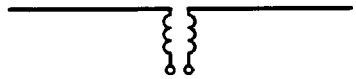
FIG. 3B (PRIOR ART)
Figure 3C:
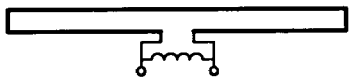
FIG. 3C (PRIOR ART)
Figure 3D:
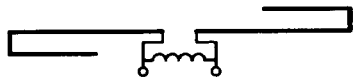
FIG. 3D (PRIOR ART)
Figure 3E:
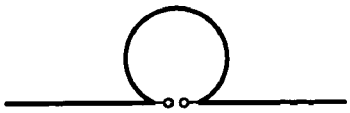
FIG. 3E (PRIOR ART)
Figure 3F:
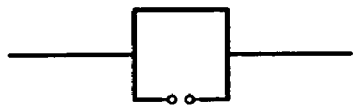
FIG. 3F (PRIOR ART)

Certain exemplary embodiments of the present invention will be described in greater detail with reference to the accompanying drawings.

In the following description, same drawing reference numerals are used for the same elements even in different drawings. The matters defined in the description such as a detailed construction and elements are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

Figure 4:
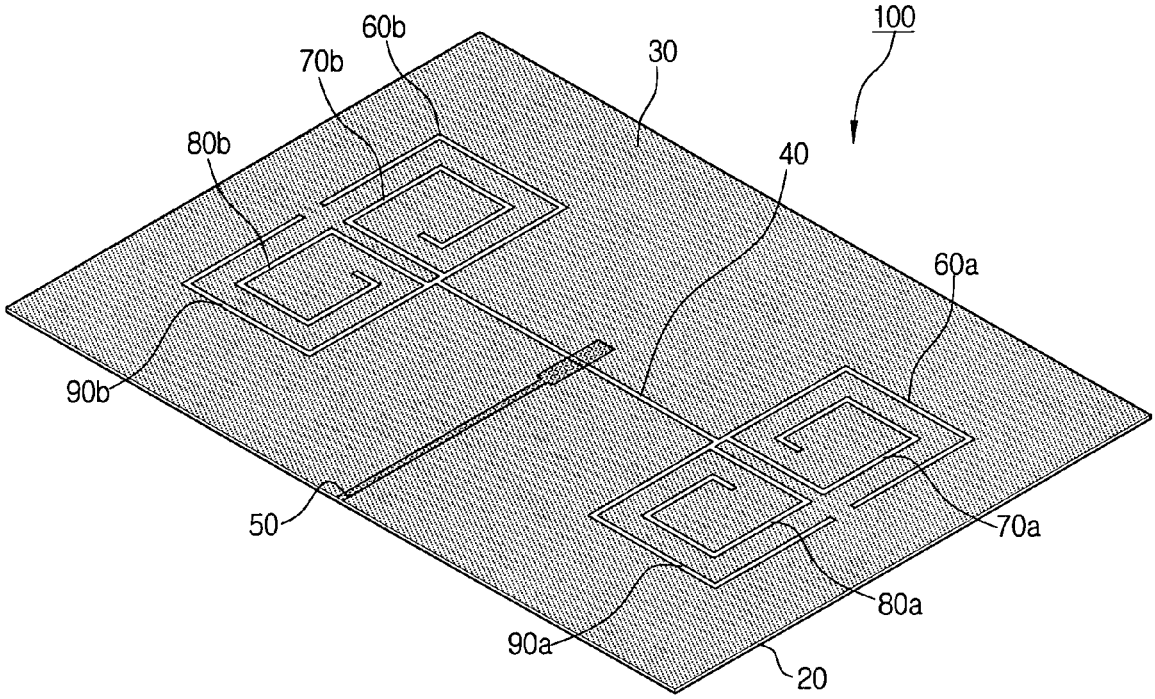
FIG. 4 is a perspective view of a small planar antenna according to an exemplary embodiment of the present invention.

FIG. 4 is a perspective view of a small planar antenna according to an exemplary embodiment of the present invention. Referring to FIG. 4, the small planar antenna 100 comprises a dielectric substrate 20, a metal layer 30 formed on an upper part of the dielectric substrate 20, a main slot 40 and a plurality of sub-slots 60*a*, 60*b*, 70*a*, 70*b*, 80*a*, 80*b*, 90*a* and 90*b* formed in pattern on the metal layer 30, and a feeder 50 formed on a lower part of the dielectric substrate 20. The metal layer 30 comprising the main slot 40 and the sub-slots 60*a*, 60*b*, 70*a*, 70*b*, 80*a*, 80*b*, 90*a* and 90*b*, forms a radiation part of the antenna 100.

Figure 5:
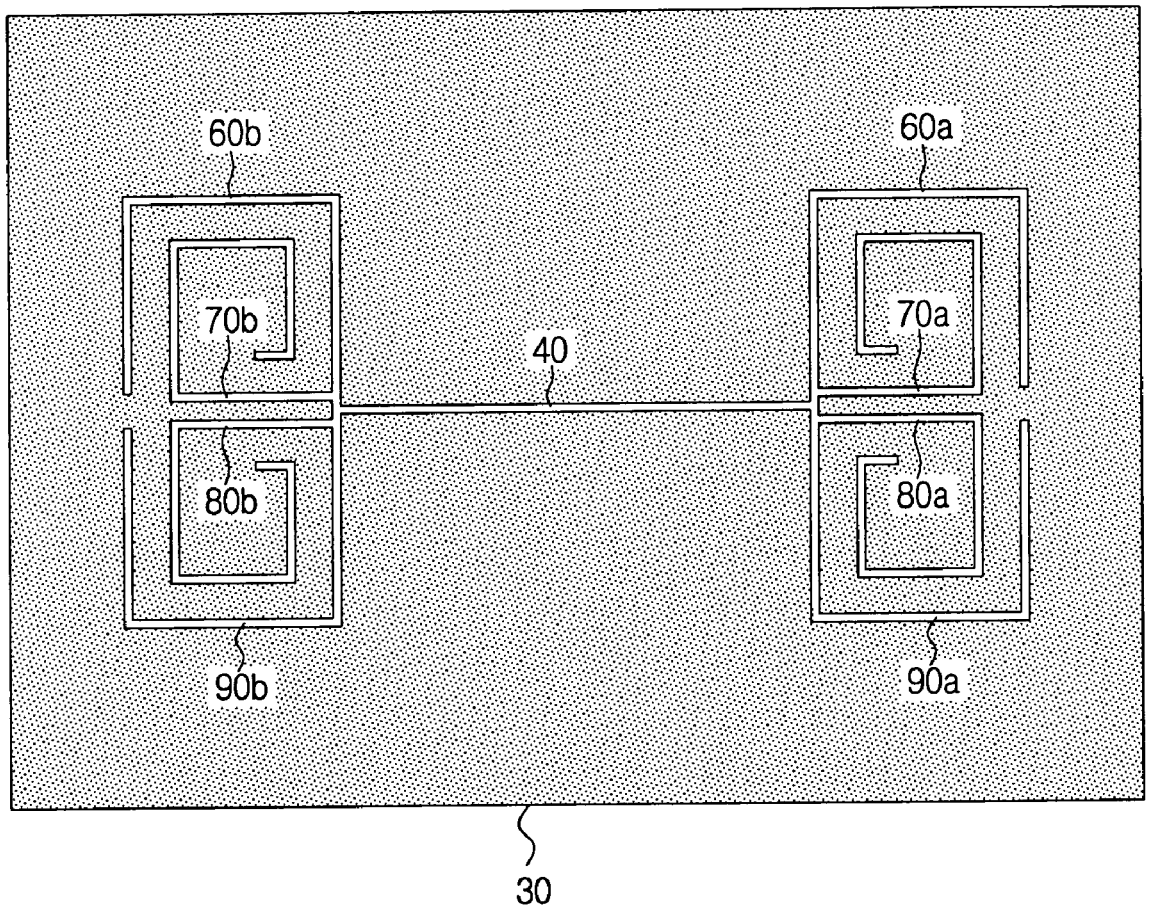
FIG. 5 is a detailed plan view of a metal layer including a main slot and a plurality of sub-slots illustrated in FIG. 4.

FIG. 5 is a detailed plan view of the metal layer including the main slot and the plurality of sub-slots illustrated in FIG. 4. The main slot, the sub-slots and the metal layer constitute the radiation part.

Referring to FIG. 5, the radiation part comprises the metal layer 30, the main slot 40, and the sub-slots 60*a*, 60*b*, 70*a*, 70*b*, 80*a*, 80*b*, 90*a* and 90*b* positioned on both sides of the main slot 40.

The respective sub-slots 60*a*, 60*b*, 70*a*, 70*b*, 80*a*, 80*b*, 90*a* and 90*b* are connected to the main slot 40. The respective sub-slots 60*a*, 60*b*, 70*a*, 70*b*, 80*a*, 80*b*, 90*a* and 90*b* have bent portions arranged clockwise or counterclockwise. The respective sub-slots 60*a*, 60*b*, 70*a*, 70*b*, 80*a*, 80*b*, 90*a* and 90*b* form a pair of symmetric sub-slot groups with respect to the longitudinal axis of the main slot 40.

That is, a right-side first sub-slot 60*a* and a right-side third sub-slot 80*a* have bent portions arranged clockwise, and a right-side second sub-slot 70*a* and a right-side fourth sub-slot 90*a* have bent portions arranged counterclockwise.

Meanwhile, left-side sub-slot 60*b* and a left-side third sub-slot 80*b* have bent portions arranged counterclockwise, and a left-side second sub-slot 70*b* and a left-side fourth sub-slot 90*b* have bent portions arranged clockwise.

Generally, the radiation part controls all electromagnetic properties of the antenna. For the miniaturization of the antenna 100, most of the radiation part should be used for radiation in order to enhance the operating bandwidth without affecting the radiation pattern, radiation efficiency, polarization purity, etc., of the antenna.

Unlike the slot pattern of the conventional antenna, the radiation part according to an exemplary embodiment of the present invention includes four sub-slots formed on each end of the main slot 40, and the respective sub-slots are symmetrically arranged with respect to the longitudinal axis of the main slot. The reason why the small planar antenna according to an exemplary embodiment of the present invention has such a complicated structure is as follows.

Generally, the maximum length of the antenna is smaller than a half-wavelength, and even smaller than ¼ of the wavelength, therefore the length of the main slot should be shortened much more. At the same time the radiating part of antenna should keep the half-wave resonant features. Accordingly, in order to achieve a size reduction, a specific value of finite voltage at both ends of a main slot should be imposed. Through this, a desired distribution of a resonance electromagnetic field is created on the shortened main slot. In order to prepare a desired voltage discontinuity on both ends of the main slot, both ends of the sub-slot should have the terminating elements possessing an induction property.

If the length of the terminating sub-slot is smaller than ¼ of the wavelength, an inductive loading is secured. Conventionally, inductive termination is prepared by two straight or spiral slots at each end of the main slot 4 (See the corresponding plurality of sub-slots 8*a* to 8*d*, 9*a* to 9*d* and 10*a* to 10*d* shown FIGS. 2A-C, 3A-F and 4). Unlike the conventional antenna, the termination of the main slot 40 according to the exemplary embodiment of the present invention is implemented by four sub-slots 60*a*, 70*a*, 80*a*, 90*a* at the right-side end and four sub-slots 60*b*, 70*b*, 80*b*, 90*b* at the left-side end all winding in the specified clockwise or counterclockwise direction in symmetrical manner.

Figure 6:
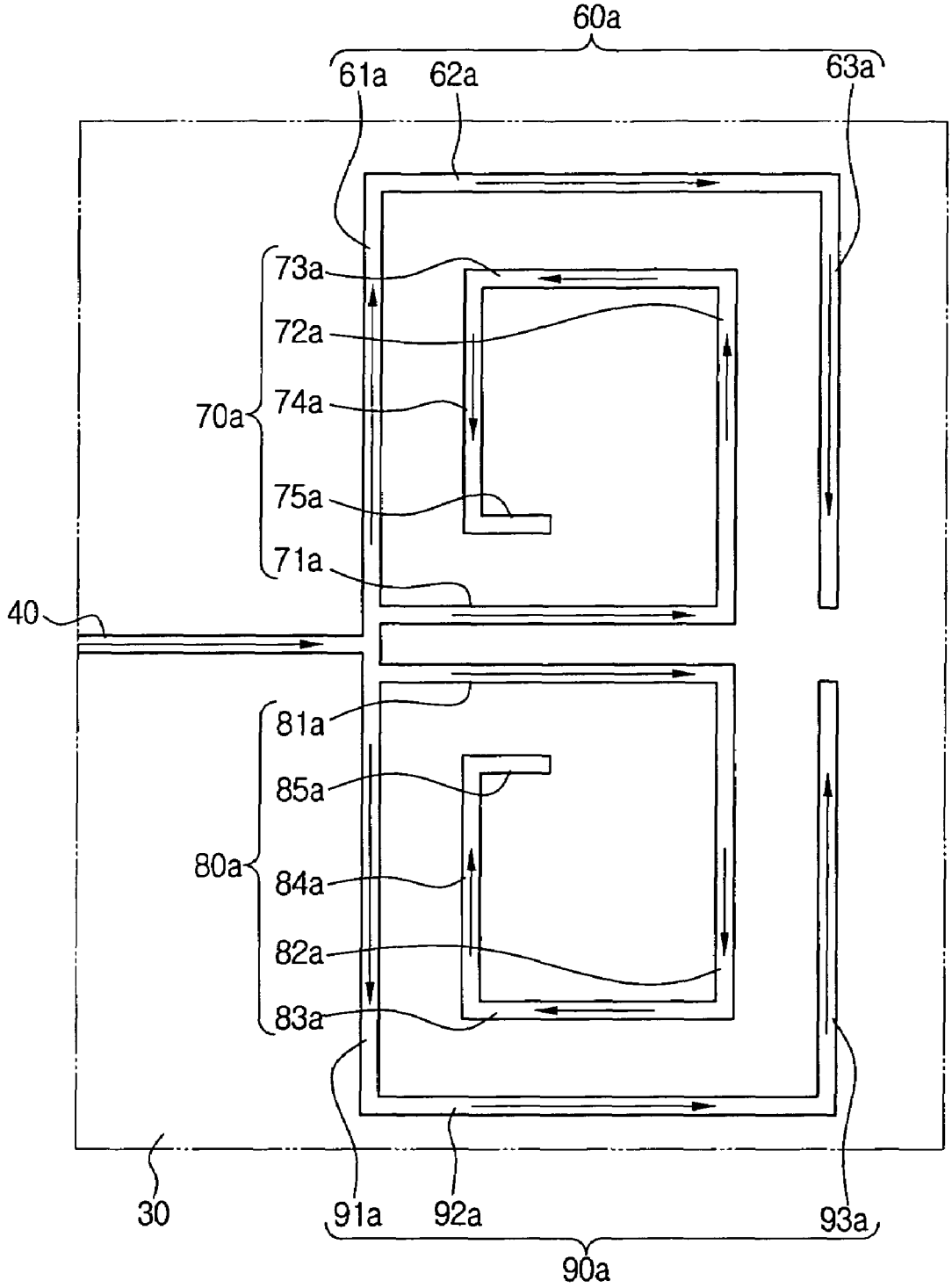
FIG. 6 is a view illustrating the magnetic current distribution in a right-side part of the slot pattern.

FIG. 6 is a view illustrating the instantaneous distribution of the magnetic current (transverse electric field in a slot line) in a slot pattern. Referring to FIG. 6, the distribution of the magnetic current is briefly illustrated along arrows. By combination of the sub-slots 60*a*, 70*a*, 80*a* and 90*a* wiring clockwise and counterclockwise, a peculiar electromagnetic property is achieved. That is, there are 6 wiring arm regions having the same magnetic current flow as the main slot. The 6 wiring arm regions are indicated by drawing reference numerals 62*a*, 71*a*, 75*a*, 81*a*, 85*a* and 92*a* in FIG. 6.

Contrary, there are only two wiring arm regions having the magnetic current flow opposite to the magnetic current flow of the main slot 40. The two wiring arm regions are indicated by drawing reference numerals 73*a* and 83*a* in FIG. 6, and the magnetic current has a small amplitude in these wiring arm regions.

Meanwhile, an undesirable field coupling effect of pairs of segments 72*a* and 74*a*, 82*a* and 84*a*, 61*a* and 63*a*, and 91*a* and 93*a* is first reduced pairwise, and then suppressed by mirror-symmetry with respect to the longitudinal axis of the main slot 40.

Accordingly, the undesirable results caused by the conventional inductive sub-slots are substantially reduced. Additionally, the useful part of magnetic current at the terminating slot arms is reclaimed successfully, thereby increasing the area of antenna that effectively participates in the radiation phenomenon. Accordingly, a small planar antenna is provided, which can operate in an enhanced bandwidth without affecting the radiation pattern, radiation efficiency, polarization purity, etc., of the antenna.

In order to compare the resultant properties of the antenna according to an exemplary embodiment of the present invention and the conventional antenna, the antennas have been designed to have the same size in the UHF band. That is, the size of the metal layer 30 is $0.21\lambda 0 \times 0.15\lambda 0$, and the size of the slot is $0.17\lambda 0 \times 0.08\lambda 0$. Here, $\lambda 0$ indicates a wavelength in free space.

The feeder of the antenna includes an open-ended microstrip line with a probe provided on the rear surface of the dielectric substrate as in the conventional antenna.

Figure 7:
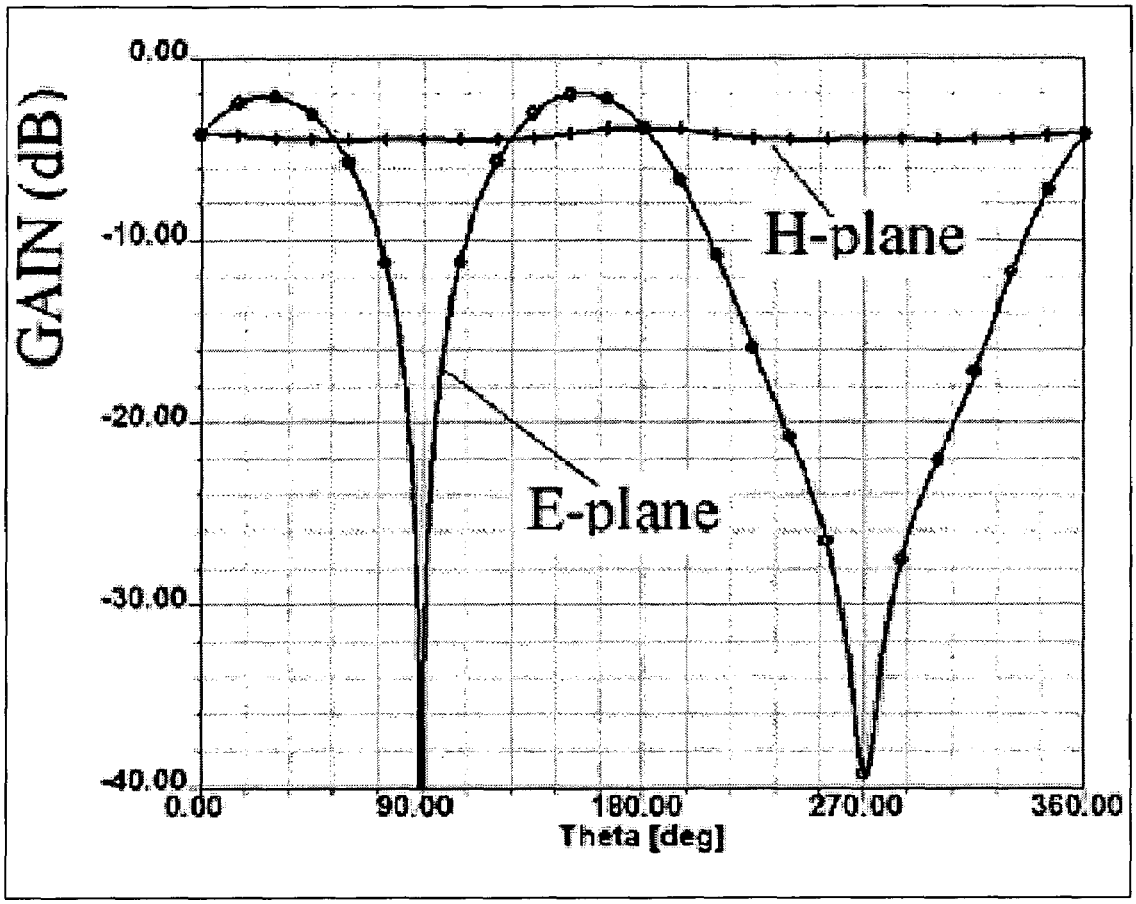
FIG. 7 is a graph illustrating the radiation patterns in an E plane and in an H plane of a conventional antenna.
Figure 8:
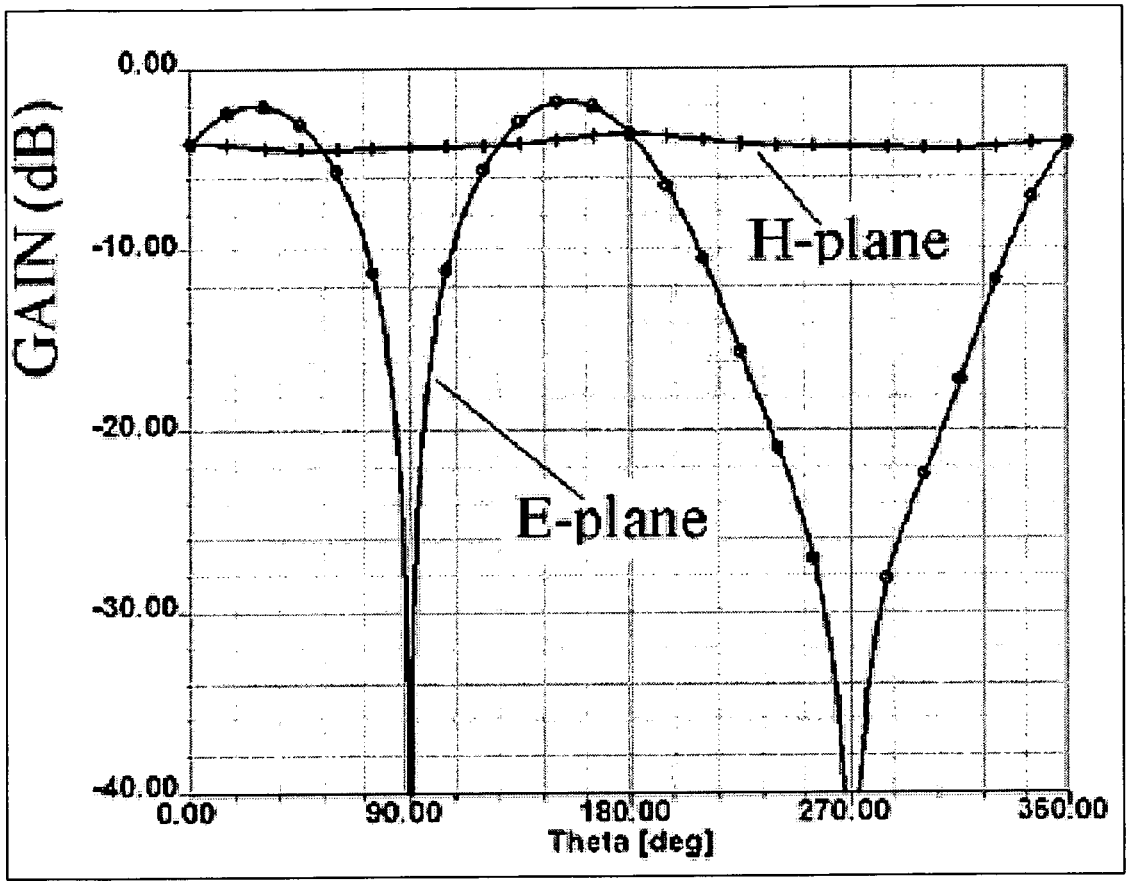
FIG. 8 is a graph illustrating the radiation patterns in an E plane and in an H plane of the small planar antenna according to an exemplary embodiment of the present invention.

FIG. 7 is a graph illustrating the radiation patterns in an E plane and in an H plane of a conventional antenna, and FIG. 8 is a graph illustrating the radiation patterns in an E plane and in an H plane of the small planar antenna according to an exemplary embodiment of the present invention.

Referring to FIGS. 7 and 8, it can be observed that the omnidirectional properties of the antenna according to an exemplary embodiment of the present invention and the conventional antenna are almost the same. The gain of the small planar antenna according to an exemplary embodiment of the present invention is −1.9 dBi, and the gain of the conventional antenna is −1.8 dBi. Accordingly, from the viewpoint of the gain and efficiency, the advantage of the antenna according to an exemplary embodiment of the present invention is weak.

Figure 9:
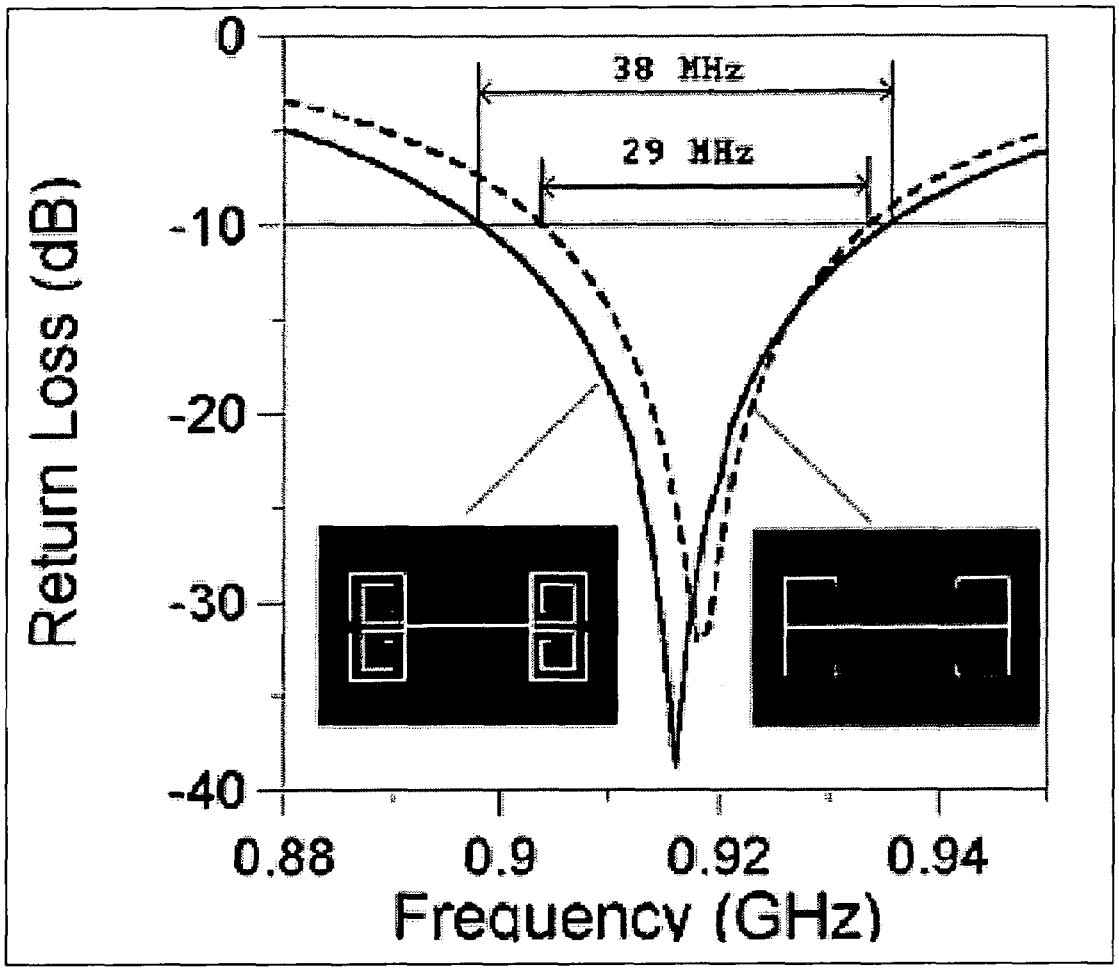
FIG. 9 is a graph illustrating the comparison of bandwidth properties through return loss between the antenna according to an exemplary embodiment of the present invention and the conventional antenna.

FIG. 9 is a graph illustrating the comparison of the bandwidth properties through return loss between the antenna according to an exemplary embodiment of the present invention and the conventional antenna. In FIG. 9, the curve illustrated as a dotted line indicates the return loss of the conventional antenna, and the curve illustrated as a solid line indicates the reflection coefficient of the antenna according to an exemplary embodiment of the present invention.

At the return loss level of −10 dB, the operating bandwidth of the antenna according to an exemplary embodiment of the present invention is 38 MHz while the operating bandwidth of the conventional antenna is only 29 MHz. Accordingly, the bandwidth of the antenna according to an exemplary embodiment of the present invention is about 30% wider than the bandwidth of the conventional antenna. At the same time the antenna according to an exemplary embodiment of the present invention is not affected in the radiation pattern, radiation efficiency, polarization purity, etc.

Figure 10:
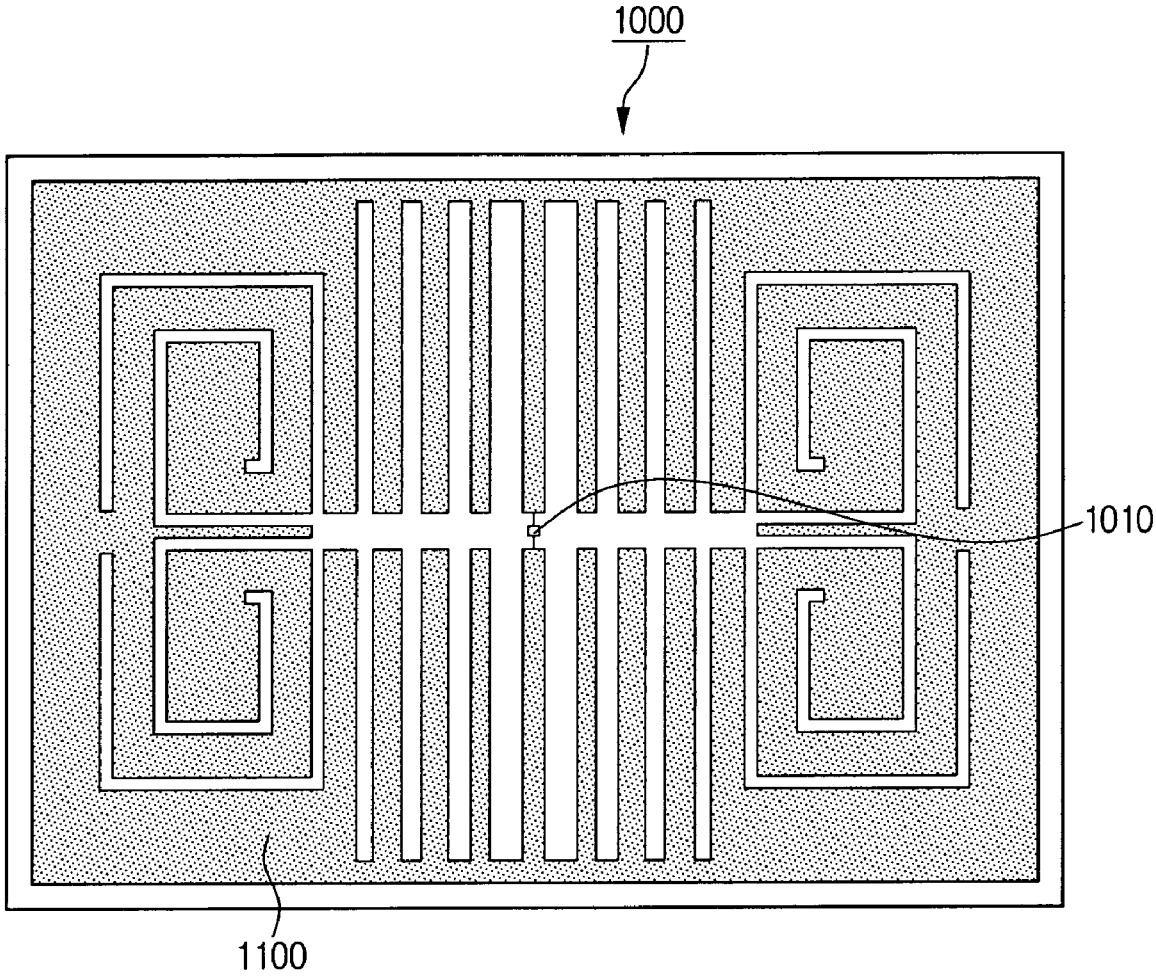
FIG. 10 is a view illustrating a rectenna according to an exemplary embodiment of the present invention.

FIG. 10 is a view illustrating a rectenna according to an exemplary embodiment of the present invention. Referring to FIG. 10, the rectenna 1000 includes a rectifying circuit built in a semiconductor chip 1010 of a transponder and an antenna 1100.

Figure 11:
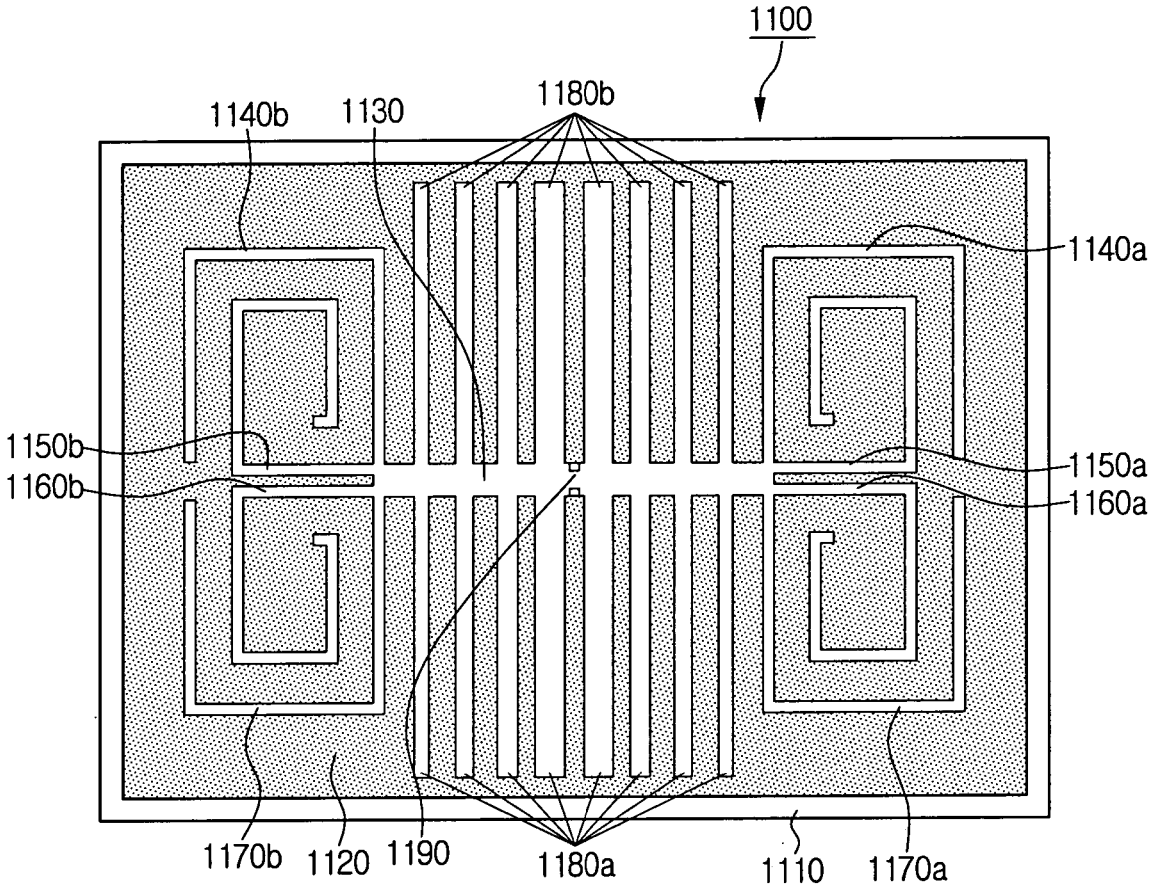
FIG. 11 is a view illustrating an antenna of FIG. 10 in a separate manner.

FIG. 11 is a view illustrating the antenna of FIG. 10 in a separate manner. The electrically small antenna 1100 includes a dielectric substrate 1110, a thin metal layer 1120 formed on an upper surface of the dielectric substrate 1110 and slot patterns formed inside the metal layer 1120. The metal layer 1120 provided with the slot patterns serves as a radiation part of the antenna 1100.

The slot pattern includes a main slot 1130, a plurality of sub-slots 1140*a*, 1140*b*, 1150*a*, 1150*b*, 1160*a*, 1160*b*, 1170*a*, and 1170*b* connected to ends of the main slot, a first transverse slot pattern 1180*a* formed at right angles to the main slot 1130 on an upper part of the main slot 1130, and a second transverse slot pattern 1180*b* formed at right angles to the main slot 1130 under a lower part of the main slot 1130. The transverse slot patterns 1180*a* and 1180*b* are symmetrically divided into two groups by the main slot 1130. The sub-slots 1140*a*, 1140*b*, 1150*a*, 1150*b*, 1160*a*, 1160*b*, 1170*a* and 1170*b* are also arranged in symmetrical manner with respect to the longitudinal axis of the main slot 1130. The power feeding to the antenna 1100 is performed from a feeder point 1190 to the slot patterns through an inlet of a semiconductor chip.

Since the overall required size of antenna is substantially less than a quarter wavelength, the length of the main slot is all the more so shorter. Therefore, in order to achieve required size reduction, a specific value of finite voltage at both ends of the main slot should be imposed. Thereby the desired resonant field distribution on shorten main slot can be situated. To arrange the desirable voltage discontinuity at the ends of the main slot the terminating sub-slots should possess the inductive properties.

Unlike the conventional structure, the respective sub-slots 1140*a*, 1140*b*, 1150*a*, 1150*b*, 1160*a*, 1160*b*, 1170*a*, and 1170*b* have bent portions arranged clockwise or counterclockwise. The respective sub-slots 1140*a*, 1140*b*, 1150*a*, 1150*b*, 1160*a*, 1160*b*, 1170*a*, 1170*b*, 1180*a* and 1180*b* form symmetric sub-slot groups around the longitudinal axis of the main slot 1130.

That is, a right-side first sub-slot 1140*a* and a right-side third sub-slot 1160*a* have bent portions arranged clockwise, and a right-side second sub-slot 1150*a* and a right-side fourth sub-slot 1170*a* have bent portions arranged counterclockwise.

Meanwhile, left-side first sub-slots 1140*b* and a left-side third sub-slot 1160*b* have bent portions arranged counterclockwise, and a left-side second sub-slots 1150*b* and a left-side fourth sub-slot 1170*b* have bent portions arranged clockwise.

As described above, the respective sub-slots 1140*a*, 1140*b*, 1150*a*, 1150*b*, 1160*a*, 1160*b*, 1170*a*, and 1170*b* arranged clockwise and counterclockwise provide peculiar electromagnetic properties so that the antenna can operate in an enhanced bandwidth without affecting the radiation pattern, radiation efficiency, polarization purity, etc., of the antenna.

Additionally, in order to prepare the concrete inductive properties of the antenna as they appear at the feeding point 1190, additional transverse slot patterns 1180*a* and 1180*b* are formed. In the exemplary embodiment of the present invention, the transverse slot patterns 1180*a* and 1180*b* induce the electromagnetic field in the neighborhood of the antenna 1100 in a peculiar method. The structure of the transverse slot patterns 1180*a* and 1180*b* provides a required ratio of reactance to resistance to the antenna. Simultaneously, the transverse slot patterns 1180*a* and 1180*b* make the antenna keep an enhanced RCS (Radar Cross Section).

A resistive (active) part of the antenna impedance is contributed by radiation phenomenon plus the losses in metal and dielectric materials that constitute the antenna. The reactive part of the antenna impedance (reactance) represents power stored in the near field of the antenna. By the transverse slot patterns formed along the main slot, the electromagnetic field surrounding the antenna is disturbed. However, since the main slot divides the transverse slot patterns symmetrically into the first transverse slot pattern 1180*a* and the second transverse slot pattern 1180*b*, the far field radiated from one of the divided transverse slot patterns is canceled by far field radiated from the other of the divided transverse slot patterns. And unique alteration in near field distribution impacts substantially on the antenna complex impedance. There, by inclusion of slot patterns 1180*a* and 1180*b* the desirable ratio of the reactance to the resistance can be achieved without affect on radiation pattern and polarization purity of rectenna.

An example of a UHF electrical small rectenna for a passive RFID transponder has been designed and made according to an exemplary embodiment of the present invention. In the exemplary embodiment of the present invention, the antenna has a size of 7×5 cm2. This size corresponds to $0.21\lambda 0 \times 0.15\lambda 0$, wherein $\lambda 0$ indicates a wavelength in a free space at a center frequency of 912 MHz.

Figure 12:
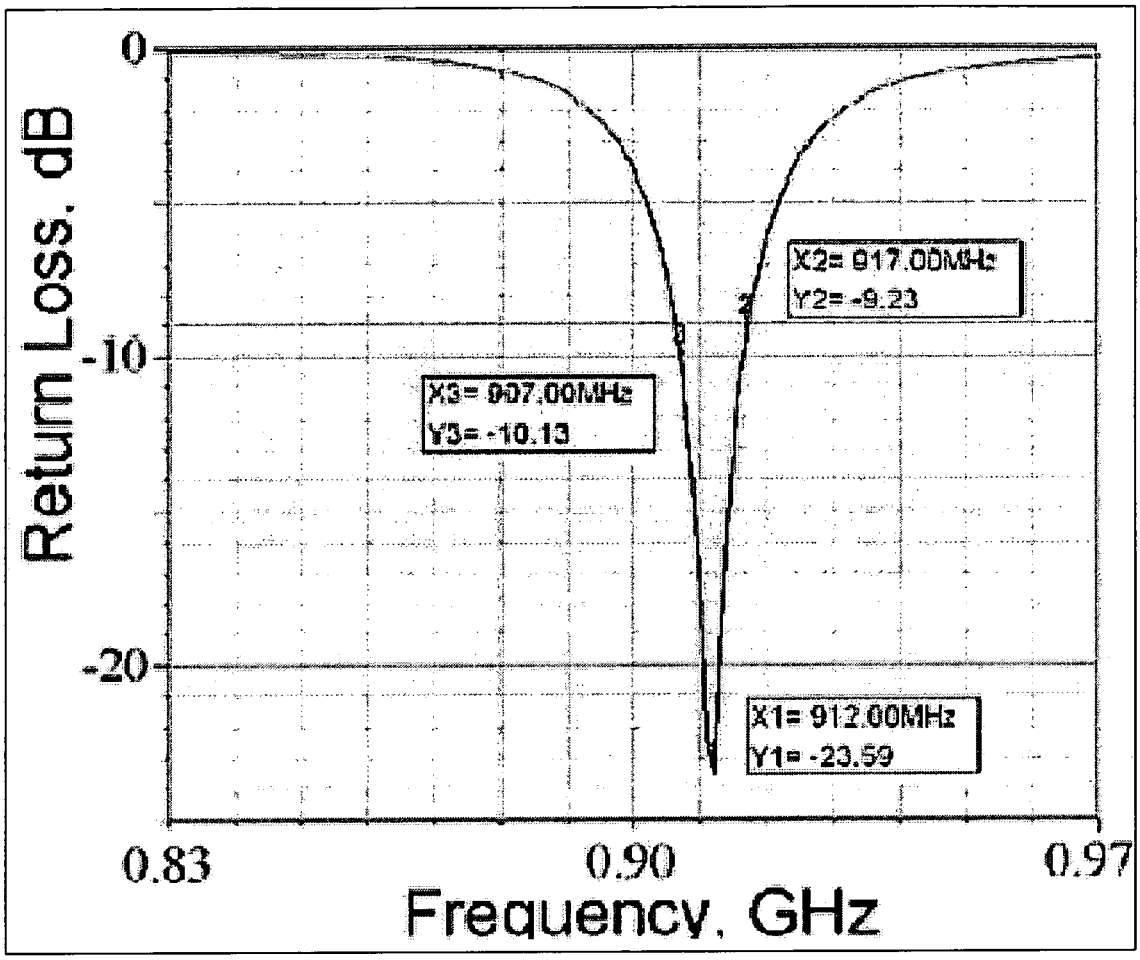
FIG. 12 is a graph illustrating the return loss of the antenna matched with a specified impedance of a semiconductor chip.

FIG. 12 is a graph illustrating the return loss of the antenna actually loaded by a specified impedance of a semiconductor chip. It is assumed that the complex impedance value of the transponder semiconductor chip is 34.5-j815 Ohm. Referring to FIG. 12, the bandwidth of the antenna at a return loss level of −10 dB is 10 MHz (i.e., 1.1%). The operation bandwidth increased as above can sufficiently be applied to the actual RFID system. The simulated radiation efficiency of the antenna reaches 75%, and both the metallic and dielectric losses should be considered. The radiation pattern is omnidirectional. The polarization is of linear type with negligible level of the cross polarization. In the case of a co-polarized normal incident wave at 912 MHz, the RCS becomes 38.4 cm2 at the conjugate matching, and becomes 6.5 cm2 in the case of short-circuit termination.

By changing the number, length, width, space, etc., of the transverse slots, a desired ratio of the reactance to the resistance can be obtained.

The RCS is a measure of indicating how well an object can reflect an electromagnetic wave. In a given wavelength and polarization, the RCS is varied according to the range of design parameters such as the size, shape, material, surface structure, etc., of an object. For example, metal surfaces reflect the electromagnetic wave better than dielectric materials.

In the case of a planar antenna as a scattering object, as metal occupies a larger area, the antenna has a larger RCS under the assumption that other conditions are the same. Accordingly, in comparison to the typical antenna in the form of a narrow metal strip pattern, the rectenna proposed according to the present invention has an enhanced RCS under the same size.

Consequently, in the exemplary embodiment of the present invention, the rectenna is provided with a small antenna conjugately matched to a transponder semiconductor chip, has an enhanced RCS and operates in an enhanced frequency bandwidth without affecting the radiation pattern, radiation efficiency, polarization purity, etc., of the antenna.

As described above, the small planar antenna according to an exemplary embodiment of the present invention has the advantages that it has an increased antenna region that substantially takes part in the radiation, and thus has an enhanced bandwidth without affecting the radiation pattern, radiation efficiency, polarization purity, etc., of the antenna.

Additionally, the small rectenna according to an exemplary embodiment of the present invention has the advantages that it is provided with a small antenna conjugately matched to a transponder semiconductor chip, has an enhanced RCS and operates in an enhanced frequency bandwidth without affecting the radiation pattern, radiation efficiency, polarization purity, etc., of the antenna.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A small rectenna comprising:

a dielectric substrate;

a metal layer formed on an upper part of the dielectric substrate;

a main slot formed in pattern on the metal layer;

a plurality of sub-slots connected to the main slot and winding in a specified direction;

a plurality of first transverse slots formed at right angles to the main slot on an upper part of the main slot;

a plurality of second transverse slots formed at right angles to the main slot under a lower part of the main slot; and an inlet of a semiconductor chip formed inside the main slot.

2. The small rectenna as claimed in claim 1, wherein the main slot, the plurality of sub slots and the plurality of first and second transverse slots perform a conjugate impedance matching to the small rectenna without any external matching element, so that the small rectenna has an enhanced RCS (Radar Cross Section) in an operating bandwidth of a transponder.

3. The small rectenna as claimed in claim 1, wherein the first and second transverse slots are divided into two symmetric groups, respectively, by a longitudinal axis of the main slot.

4. The small rectenna as claimed in claim 1, wherein the specified direction is either of clockwise and counterclockwise directions.

5. The small rectenna as claimed in claim 1, wherein the plurality of sub-slots that form a pair of symmetric sub-slot groups around a longitudinal axis of the main slot wind in opposite directions to each other.

6. The small rectenna as claimed in claim 2, wherein the plurality of sub-slots comprises:

a right-side first sub-slot winding clockwise from a right-side upper end part of the main slot;

a right-side second sub-slot winding in an opposite direction to the right-side first sub-slot from an inside of the right-side first sub-slot;

a right-side fourth sub-slot winding in an opposite direction to the right-side first sub-slot from a right-side lower end part of the main slot; and a right-side third sub-slot winding in an opposite direction to the right-side fourth sub-slot from an inside of the right-side fourth sub-slot.

7. The small rectenna as claimed in claim 6, wherein the plurality of sub-slots further comprises:

a left-side first sub-slot winding counterclockwise from a left-side upper end part of the main slot;

a left-side second sub-slot winding in an opposite direction to the left-side first sub-slot from an inside of the left-side first sub-slot;

a left-side fourth sub-slot winding in an opposite direction to the left-side first sub-slot from a left-side lower end part of the main slot; and a left-side third sub-slot winding in an opposite direction to the left-side fourth sub-slot from an inside of the left-side fourth sub-slot.

8. The small rectenna as claimed in claim 1, wherein the dielectric substrate and the metal layer are planar.

9. The small rectenna as claimed in claim 1, wherein the semiconductor chip further includes a rectifying circuit.

* * * * *